United States Patent [19]

Randall

[11] Patent Number: 4,665,953

[45] Date of Patent: May 19, 1987

[54] REVERSIBLE SAFETY WIRE PLIERS

[76] Inventor: Paul D. Randall, 826 So. 20th St., Omaha, Nebr. 68108

[21] Appl. No.: 809,407

[22] Filed: Dec. 16, 1985

[51] Int. Cl.[4] ..... B21F 7/00

[52] U.S. Cl. ..... 140/118; 140/121

[58] Field of Search ..... 140/118, 119, 121; 81/319, 323, 324

[56] References Cited

U.S. PATENT DOCUMENTS

| | | | |
|---|---|---|---|
| 468,005 | 2/1892 | Newitt | 140/121 |
| 1,256,288 | 2/1918 | Barnes . | |
| 1,436,637 | 11/1922 | Bates | 140/119 |
| 2,300,392 | 11/1942 | Austin | 145/50 |
| 2,481,633 | 9/1949 | Wehner | 81/57 |
| 2,521,816 | 9/1950 | Adams | 74/127 |
| 2,737,983 | 3/1956 | Pray | 140/118 |

FOREIGN PATENT DOCUMENTS

| | | | |
|---|---|---|---|
| 457068 | 5/1950 | Italy | 140/118 |

*Primary Examiner*—Lowell A. Larson

*Attorney, Agent, or Firm*—Zarley, McKee, Thomte, Voorhees & Sease

[57] ABSTRACT

A reversible safety wire pliers is disclosed which includes a sleeve mounted on one arm of the pliers, the sleeve having a double spiral shank with left-hand and right-hand grooves enclosed therein. A pair of externally toothed gears are mounted on the shank, each gear having a pair of diametrically opposed internal guide tooth seated in the left-hand or right-hand grooves such that the gears will rotate in opposite directions as the shank is pulled through the sleeve. A pair of gear-engaging plates are pivotally carried in a slot in the sleeve and when pivoted in one direction will engage the associated gear, thereby locking it in relation to the sleeve, and will disengage from the associated gear when pivoted in the opposite direction. A slide switch and spring are utilized to selectively engage one gear while simultaneously disengaging the other. A hook in combination with a biased, slidable, slotted, receiving member is used to automatically lock the plier arms in the closed position. The plier arms may be manually unlocked.

4 Claims, 8 Drawing Figures

REVERSIBLE SAFETY WIRE PLIERS

TECHNICAL FIELD

The present invention relates generally to safety wire pliers and more particularly to improved safety wire pliers capable of reversible twisting action.

BACKGROUND ART

In the manufacture of machinery subject to continuous vibration, it is common to provide additional security to maintain the various bolts in their tightened condition. This is especially critical in the aerospace and aircraft industry, where the loosening of a bolt can have catastrophic results.

The most common apparatus for securing bolts in their tightened positions is safety wire tied between two or more bolt heads. The bolts are specially made with an aperture in the bolt head; the wire being inserted therethrough and looped around each bolt head. In order to maintain a taut wire between the bolt heads, as well as to bias each looped portion towards the machinery, the strands of the safety wire are twisted before being tied to an adjacent bolt. Conventional safety wire pliers are employed to impart this twist from the first bolt to the second. After looping the safety wire about the second bolt head, the strands are twisted in the opposite direction and tied off or tied to a third bolt.

Although the inventor knows of pliers which are utilized in the art of securing safety wires to bolt heads, all such known pliers are only capable of twisting action in a single direction. Thus, after wiring the first bolt head and looping the wire around the second bolt head, the safety wire pliers must be manually twisted in the opposite direction before tying the safety wire.

A second inconvenience of conventional safety wire pliers is that it is necessary to use two hands to manually lock the pliers onto the pair of safety wire strands. Release of the wires is a simpler task, which does not require the use of both hands. This manual locking of the pliers, though not a critical problem, is an inconvenience which decreases the efficiency of the tool in its normal operation.

Another problem common to safety wire pliers known to the inventor is the difficulty in replacing worn out or broken parts thereof. It is typically necessary to replace the entire pair of pliers in such an occurrence.

Therefore, it is a general object of the present invention to provide improved safety wire pliers.

Yet another object is to provide safety wire pliers which are capable of reversible twisting action.

Still another object of the present invention is to provide safety wire pliers with plier arms which will automatically lock when squeezed shut.

A further object of the invention is to provide safety wire pliers which are designed for ease of replacement of the various parts.

These and other objects will be apparent to those skilled in the art.

SUMMARY OF THE INVENTION

A reversible safety wire pliers is disclosed which includes a sleeve mounted on one arm of the pliers, the sleeve having a double spiral shank with left-hand and right-hand grooves enclosed therein. A pair of externally toothed gears are mounted on the shank, each gear having a pair of diametrically opposed internal guide tooth seated in the left-hand or right-hand grooves such that the gears will rotate in opposite directions as the shank is pulled through the sleeve. A pair of gear-engaging plates are pivotally carried in a slot in the sleeve and when pivoted in one direction will engage the associated gear, thereby locking it in relation to the sleeve, and will disengage from the associated gear when pivoted in the opposite direction. A slide switch and spring are utilized to selectively engage one gear while simultaneously disengaging the other. A hook in combination with a biased, slidable, slotted, receiving member is used to automatically lock the plier arms in the closed position. The plier arms may be manually unlocked.

BEST MODE FOR CARRYING OUT THE INVENTION

Figure 1:
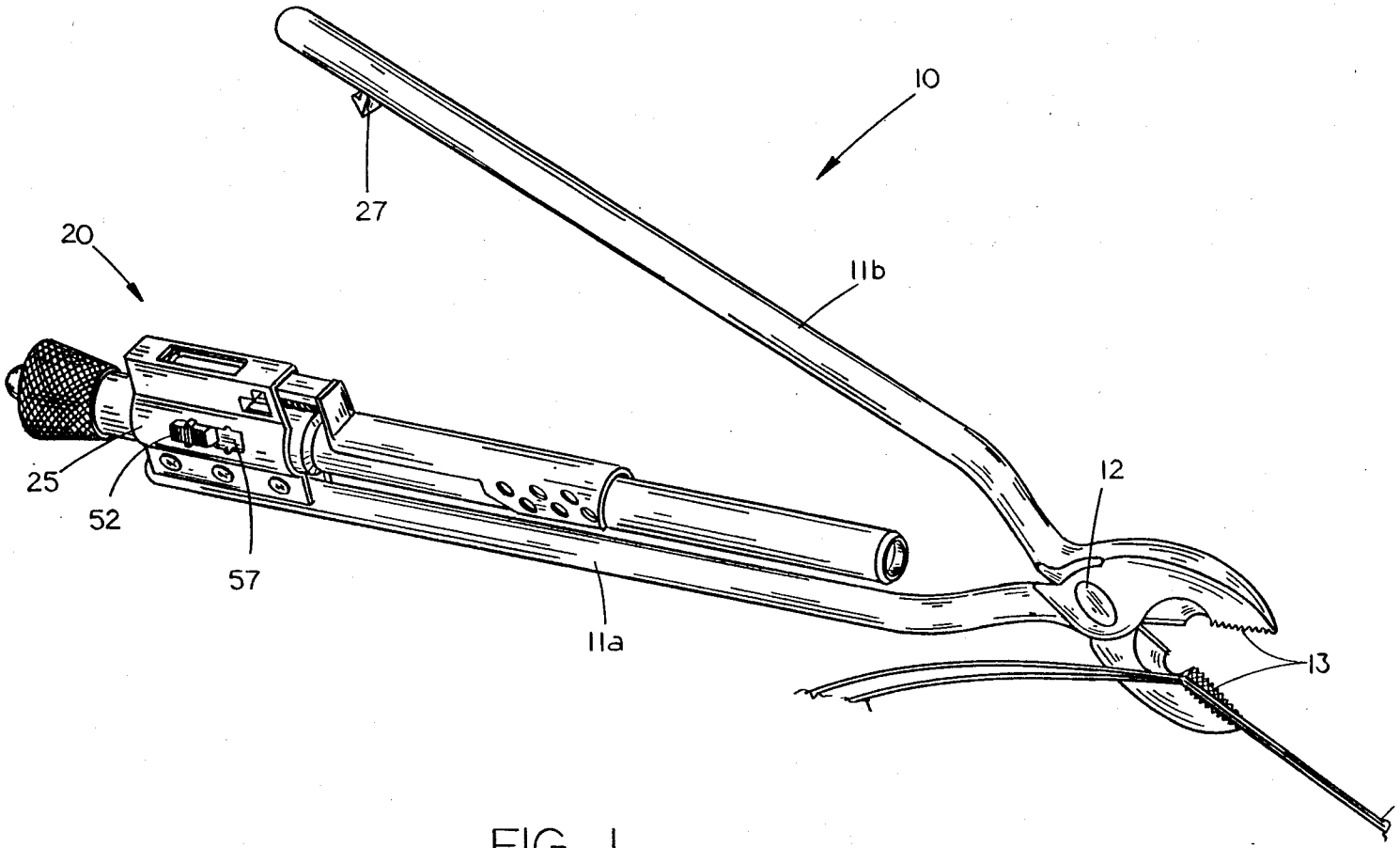
FIG. 1 is a perspective view of the pliers with a pair of safety wires extended between the jaws thereof.

Referring now to the drawings, in which similar or corresponding parts are designated by the same reference character throughout the several views, and more particularly to FIG. 1, the reversible safety wire pliers of this invention is designated generally at 10, and includes a pair of plier arms 11*a* and 11*b* pivotally connected in a conventional manner via rivet 12 intermediate the ends thereof. Plier arms 11*a* and 11*b* have a conventional toothed jaw 13 on one end and are free at the other end. Attached to one plier arm 11*a* is a reversible plier rotating mechanism, designated generally at 20.

Figure 2:
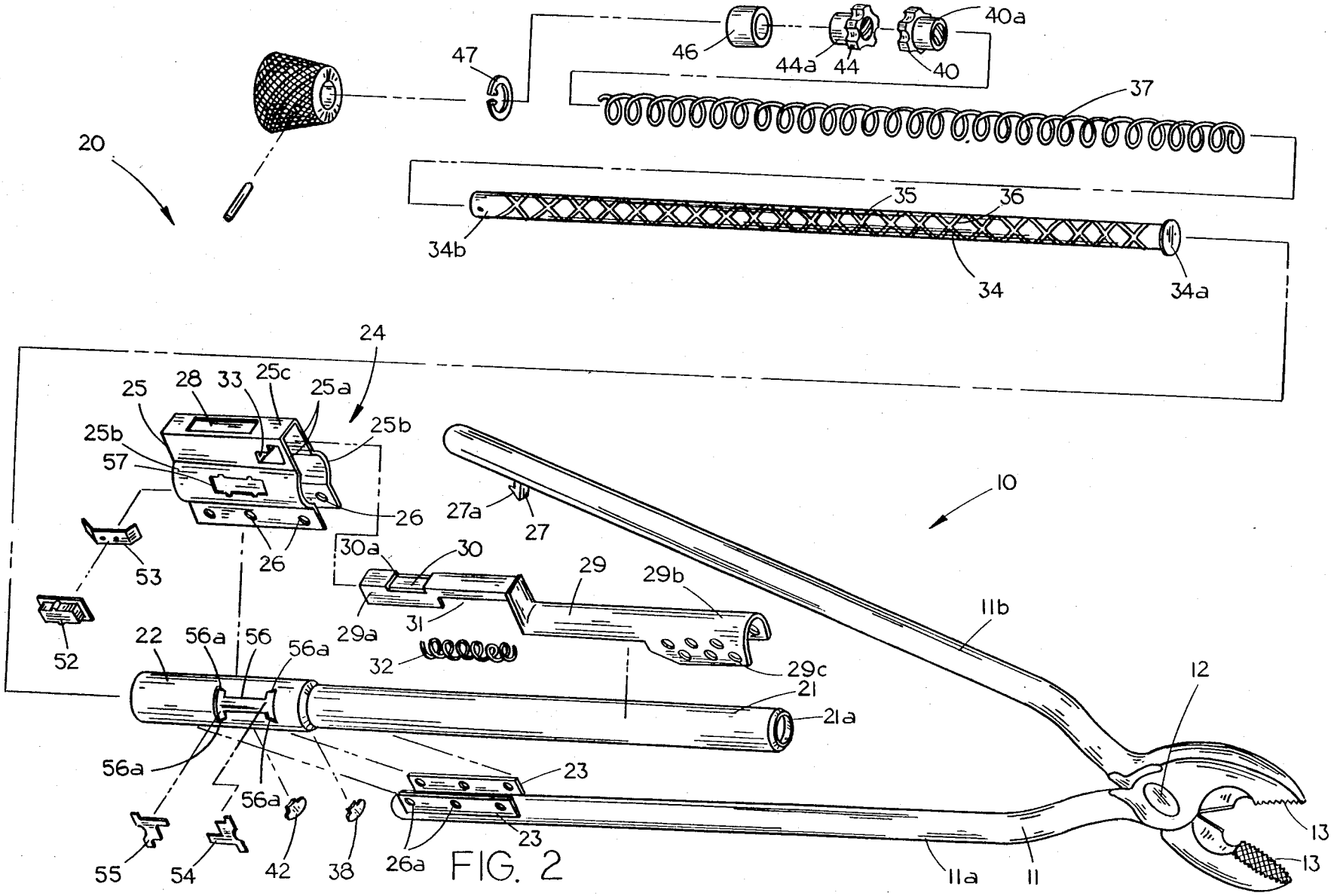
FIG. 2 is an exploded perspective view showing the various parts of the safety wire pliers.

Referring now to FIG. 2, reversible plier rotating mechanism 20 includes a sleeve 21 having a larger diameter portion 22 at one end, hereinafter referred to as housing 22. Sleeve 21 is affixed to plier arm 11*a* at housing 22 via a pair of plates 23 affixed along one edge to each side of plier arm 11*a*. The opposite edge of each plate 23 is affixed to each side of housing 22. Sleeve 21 is mounted with its longitudinal axis parallel to plier arm 11*a* and aligned with rivet 12.

Figure 5:
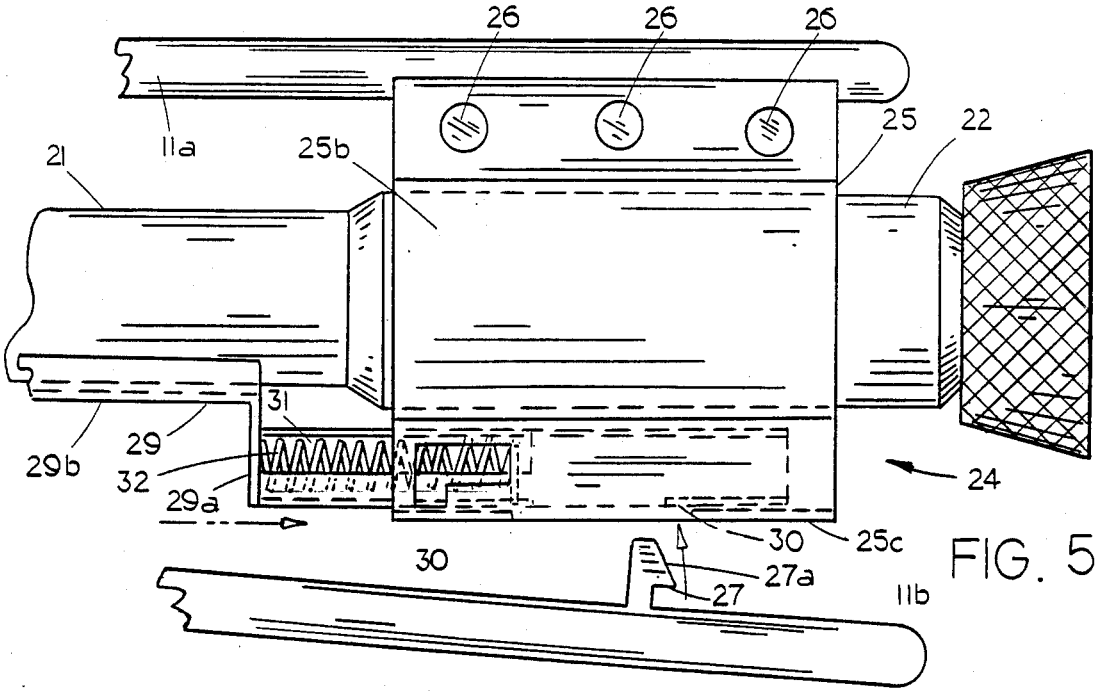
FIG. 5 is a side view showing the plier arm locking mechanism of the invention.

Referring now to both FIGS. 2 and 5, an automatic plier arm locking mechanism, designated generally at 24, is utilized to automatically lock plier arms 11*a* and 11*b* in a closed position once squeezed together by the user. Locking mechanism 24 includes a generally U-shaped bracket 25 having legs 25*a* of a length greater than the diameter of housing 22. Each leg 25*a* of U-shaped bracket 25 has a channel-shaped portion 25*b* extending along its width and of such a configuration so as to fit snugly about housing 22. Apertures 26 are located along the free ends of legs 25*a* of U-bracket 25 and correspond to apertures 26*a* located along plates 23 on plier arm 11*a*. Apertures 26 and 26*a* are utilized in combination with rivets (not shown) to fasten bracket 25 to plier arm 11*a* with legs 25*a* firmly holding housing 22.

Plier arm 11*b* has a hook shaped latch 27 affixed near the free end thereof on the side adjacent plier arm 11*a*. Latch 27 is mounted so as to be received within a slot 28 in the bottom portion 25*c* of U-bracket 25.

A slidable arm 29 has a rectangular tubular rear portion 29*a* connected to a sleeve-embracing forward portion 29*b* having a generally semi-circular cross-section, and is adapted for slidable movement along sleeve 21. Rear portion 29*a* has a length greater than the width of U-bracket 25 and a height and width of a dimension adapted to slide within U-bracket 25 in the tubular portion formed between bottom portion 25*c* and housing 22. When inserted intothe tubular portion of U-bracket 25, rear portion 29*a* of slidable arm 29 will extend slightly beyond the forward end of U-bracket 25. A slot 30 is located in rear portion 29*a* adjacent slot 28 in bottom portion 25*c* of U-bracket 25, and has a length and width equal thereto. The rearward edge 30*a* of slot 30 in rear portion 29*a*, is biased forward (as explained hereinbelow) so as to be received within latch 27 when plier arms 11*a* and 11*b* are squeezed together. Latch 27 has a sloped portion 27*a* to force slot edge 30*a* to slide rearwardly prior to locking into latch 27.

A second slot 31 is located on the side of rear portion 29*a* opposite of slot 30, and extends between the forward end of slot 30 and the connection of rear portion 29*a* to forward portion 29*b*. The chamber formed by slot 31 in rear portion 29*a* houses a compression spring 32.

A tab is created in one leg 25*a* of U-bracket 25 and is bent inwardly into slot 31 near the rearward end thereof. Thus, tab 33 will act as a stop for one end of compression spring 32 as rear portion 29*a* slides within the tubular portion of U-bracket 25. The opposing end of compression spring 32 will bias against the front end of rear portion 29*a*. It can therefore be seen that as latch 27 on plier arm 11*b* is squeezed towards plier arm 11*a*, latch 27 will pass within slot 28 of U-bracket 25 and also into slot 30 of rear portion 29*a* of slidable arm 29. Latch 27 faces rearwardly such that it will hook on slot edge 30*a* and will be held in place due to the biasing force of compression spring 32 on rear portion 29*a*.

Forward portion 29*b* of slidable arm 29 has an enlarged portion 29*c* at its forward end which embraces sleeve 21. Enlarged portion 29*c* will thereby guide slidable arm 29 as it slides within U-bracket 25. Enlarged portion 29*c* will also allow easy gripping by the user, to allow the user to move slidable arm 29 rearwardly to release latch 27 from slot edge 30*a*.

Figure 3:
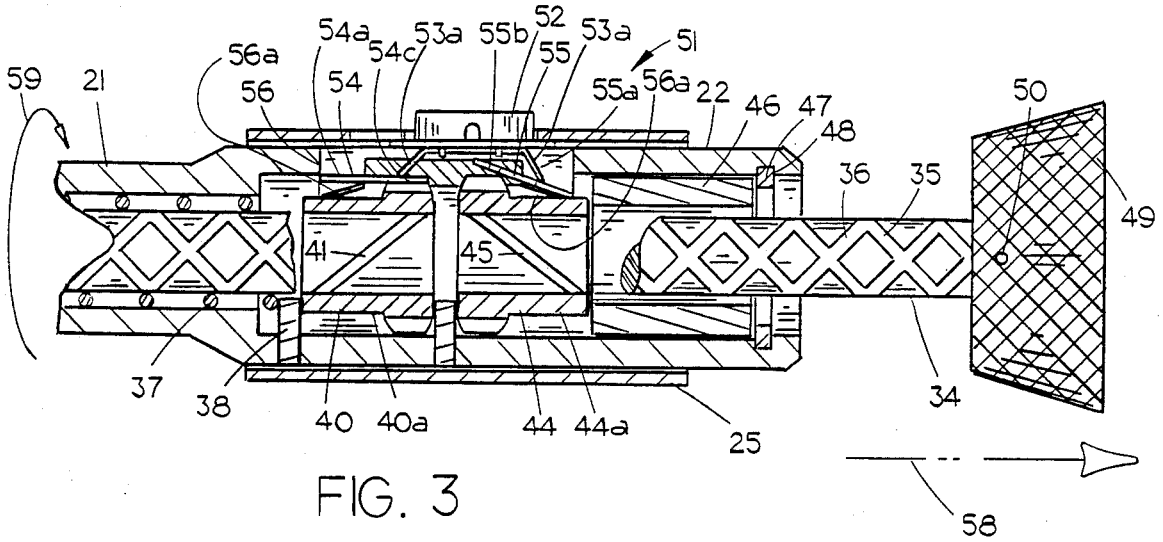
FIG. 3 is a top sectional view showing the directional switch set for clockwise rotation of the pliers.
Figure 4:
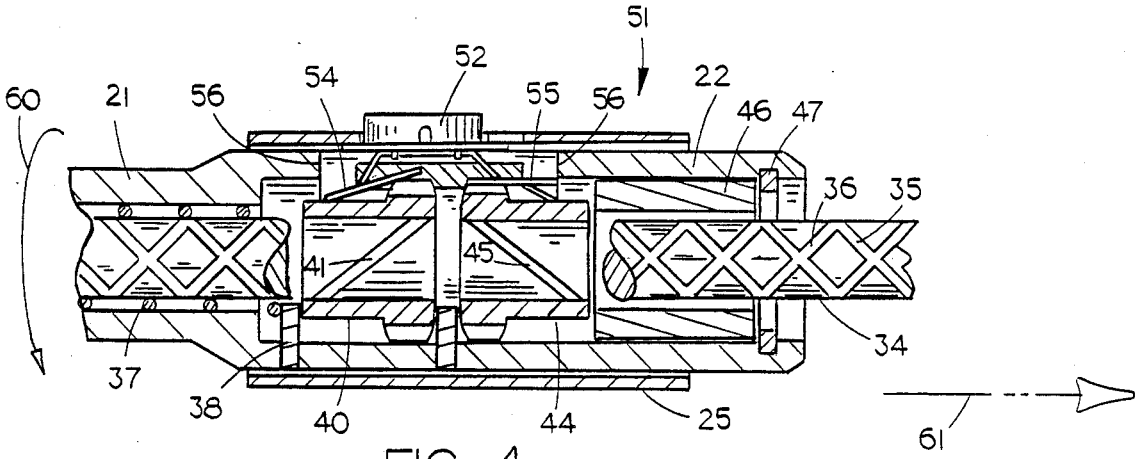
FIG. 4 is a partial top sectional view showing the directional switch set for rotation of the pliers in a counterclockwise direction.

Referring now to FIGS. 2, 3 and 4, reversible plier-rotating mechanism 20 also includes a double spiral grooved shank 34 having a pair of diametrically opposed right-hand grooves 35 and a like pair of diametrically opposed left-hand grooves 36 extending from end to end. Shank 34 has a diameter slightly less than the interior diameter of sleeve 21 and is of a length slightly greater than the combined length of sleeve 21 and housing 22.

Figure 6:
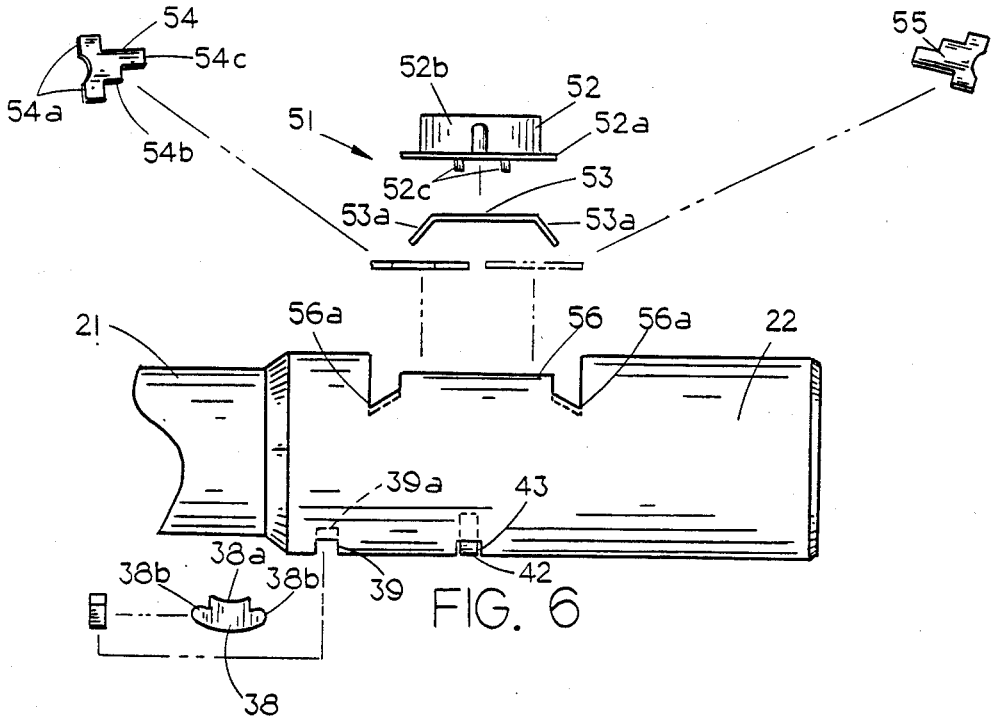
FIG. 6 is an exploded side view of the directional switch.

A compression spring 37 surrounds shank 34 and extends from the forward end 34*a* hereof to approximately the forward end of housing 22. The forward end 34*a* of shank 34 has an annular lip which serves as a stop for one end of spring 37. A flat stop 38 interposed perpendicularly to shank 34 through a slot 39 in housing 22 (as shown in FIG. 6), serves as a stop for the other end of spring 37. Stop 38 has an arcuate edge 38*a* adjacent shank 34, and a pair of ears 38*b* which rest on notched portions 39*a* at each end of slot 39. Thus, stop 38 will slide within slot 39 and generally conform to the outside circumference of housing 22.

An externally-toothed spur gear 40 is fitted on shank 34, and has a hub portion 40*a* which will bear against stop 38 as shown particularly in FIGS. 3 and 4. Gear 40 is internally bored to fit on the smooth surface portion of shank 34 intermediate grooves 35 and 36, but is provided with a pair of diametrically opposed internally directed guide teeth 41, each of which is adapted to seat in one of the left-hand grooves 36 of shank 34.

A second flat stop 42 is interposed perpendicular to shank 34 through a slot 43 in housing 22 to hold gear 40 in its longitudinal position along shank 34. Stop 42 and slot 43 are identical to stop 38 and slot 39 located on the opposing end of gear 40. A second externally-toothed spur gear 44 is likewise fitted over shank 34. Gear 44 is substantially identical to gear 40 and has a hub portion 44*a*. Gears 40 and 44 are arranged in end-to-end relation along shank 34 with the gear teeth thereof adjacent each other on opposing sides of stop 42. Gear 44 is also provided with a pair of diametrically opposed internally directed guide teeth 45 which are the same as guide teeth 41 of gear 40 but which engage in the two right-hand grooves 35 of shank 34. A spacer 46 is fitted on shank 34 adjacent gear 44 and extends to the rearward end of housing 22 where it abuts a snap ring 47 surrounding shank 34 and mounted within an annular slot 48 on the interior of housing 22.

The rearward end of shank 34 has a knurled knob 49 mounted thereon with a pin 50 in a conventional manner. Thus, it can be seen that shank 34 may be pulled rearwardly via knob 49, compressing spring 37 against stop 38 and simultaneously rotating gears 40 and 44 in opposing directions as they follow right-hand and left-hand grooves 35 and 36. Shank 34 will return to its original position when released due to the biasing force of spring 37 against the forward end 34*a* of shank 34. Knob 49 will contact the end of housing 22 when shank 34 reaches it original position within sleeve 21.

A switch assembly, designated generally at 51, is used to lock either gear 40 or 44 in engagement with housing 22, thereby causing plier arms 11*a* and 11*b* to rotate in one direction or the other with sleeve 21 about shank 34. Referring now to FIGS. 2, 3, 4 and 6, switch assembly 51 includes a conventional slide switch 52, spring 53, and locking plates 54 and 55, all installed within a generally H-shaped slot 56 in housing 22. A generally rectangularly shaped slot 57 in the side of U-bracket 25 allows U-bracket 25 to cover the various components of switch assembly 51 while exposing slide switch 52, as shown in FIG. 1.

Slide switch 52 has a flat base portion 52*a* sightly wider and longer than the upper portion 52*b*, such that U-bracket 25 will hold slide switch 52 within slot 57. A pair of prongs 52*c* depend from base portion 52*a* and correspond to a pair of apertures in spring 53, such that spring 53 will be shifted with switch 52. Spring 53 has a pair of downwardly extending legs 53*a* which will bias against locking plates 54 and 55 as described hereinbelow.

Since locking plates 54 and 55 are identical, but in reversed positions, only one will be described herein. Locking plate 54 is generally in the shape of a "T" having ears 54*a* which fit within one leg of H-shaped slot 56. The intermediate portion 54*b* of locking plate 54 is generally of a width equal to the cross bar of H-shaped slot 56 and will pass therethrough. A tab 54*c* extends from intermediate portion 54*b* and has a width slightly less than the distance between a pair of teeth on gear 40 for engagement therewith. Slanted tabs 56*a* in the upper and lower ends of the legs of the H-shaped slot 56 extend inwardly to allow the ears 54*a* of locking plate 54 to rest thereon.

Referring now to FIG. 3, switch 52 is shown in its rearward position, thereby engaging locking plate 54 on gear 40, and disengaging locking plate 55 from gear 44. One leg 53*a* of spring 53 biases downwardly on locking plate 55 forcing the ears onto tabs 56*a* of H-shaped slot 56, thereby causing locking plate 55 to tilt upwardly such that its tab 55*b* is raised above the teeth of gear 44, and allowing gear 44 to rotate freely within housing 22. Simultaneously, the opposite leg 53*a* of spring 53 biases downwardly on tab portion 54*c* of locking plate 54 causing the tab 54*c* to engage with the teeth of gear 40, locking plate 54 taking on a generally horizontal position locked in place within H-shaped slot 56. In this position, it can be seen that an outward pull on knob 49, as shown by arrow 58, will cause guiding teeth 41 of gear 40 to follow left-hand grooves 36 on shank 34 thereby rotating housing 22 and sleeve 21 in a clockwise direction, as shown by arrow 59. Referring now to FIG. 4, switch 52 is in its forward position, in which locking plate 54 will be disengaged from gear 40 and locking plate 55 will be engaged with gear 44. This arrangement will thereby cause housing 22 and sleeve 21 to rotate in a counterclockwise direction as shown by arrow 60, when knurled knob 49 is pulled outwardly, as shown by arrow 61.

Figure 7:
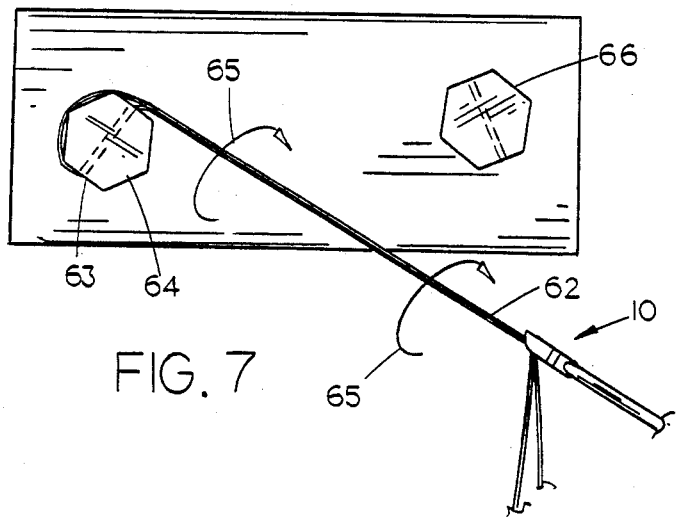
FIG. 7 is a diagrammatic illustration of the twisting of the ends of a safety wire extended through a first bolt head.
Figure 8:
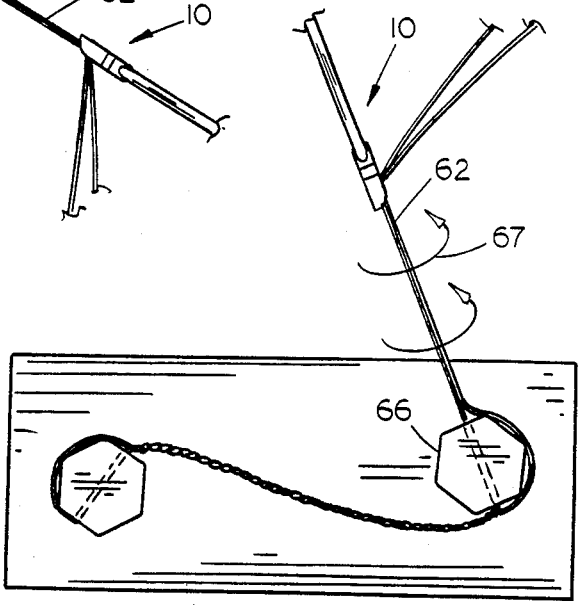
FIG. 8 is a diagrammatic illustration of the twisting of the end of a safety wire after extended through a second bolt head.

In operation, the reversible safety wire pliers 10 as shown in FIG. 7, will be clamped upon the two strands of a safety wire 62 which has been inserted through a bolt head aperture 63 and looped over half the bolt head 64. By moving switch 52 to its rearward position (as shown in FIG. 3) and pulling on knob 49, pliers 10 will be caused to rotate in a clockwise direction, as shown by arrows 65, thereby twisting the pair of safety wire strands 62 so as to bias the looped portion about bolt head 64 towards the machinery. The pliers 10 are then manually unlocked, as described hereinabove, to release the pair of safety wire strands 62 so that they may be looped around the second bolt head 66 as shown in FIG. 8. Switch 52 is then moved to its forward position (as shown in FIG. 4) so that when pliers 10 are clamped again on safety wires 62 the wires will be twisted in a counterclockwise direction, as shown by arrows 67 in FIG. 8. The strands of safety wire 62 may then be tied off or extended to a third bolt head, the process being reversed again in order to bias the loop about the bolt head so that it will not loosen.

While the invention has been shown and explained in its preferred embodiment, it is to be understood that the invention should not be confined to the exact showing of the drawing nor the precise construction described, and that any variations, substitutions, and modifications are intended to be comprehended within the spirit of the invention, and that the invention is to be limited only by the appended claims.

What is claimed is:

1. A reversible safety wire pliers, comprising, a pair of plier arms, each having a jaw end, pivotally connected together proximal the jaw ends thereof;

a sleeve mounted on one of said plier arms and positioned with its longitudinal axis generally aligned with the pivotal connection of said plier arms and generally parallel to said plier arms when they are in a closed position;

said sleeve including an enlarged portion extending to one end of said sleeve;

a double spiral grooved shank having at least one left-hand groove and at least one right-hand groove, said shank having a length greater than said sleeve and adapted for slidable movement within said sleeve;

a pair of externally toothed gears slidably and concentrically mounted on said shank within the enlarged portion of said sleeve, one of said gears including a pair of diametrically opposed internally directed guide teeth slidably seated in said left-hand groove,the other gear including a pair of diametrically opposed internally directed guide teeth slidably seated in said right-hand groove;

said enlarged portion of said sleeve having an interior diameter adapted to allow said toothed gears to be removed from said sleeve along said shank;

means removably connected to said sleeve for holding said gears in their longitudinal position along said shank;

gear engaging locking means carried within a longitudinally extending slot in the enlarged portion of said sleeve in the region of said gears, said slot extending beyond each toothed portion of said gears, said locking means including:

a first gear engaging plate pivotally carried within said slot in said sleeve, one end of said first plate in engagement with said left-hand guided gear when pivoted to one extreme, and disengaged from said gear when pivoted to the opposite extreme;

a second gear engaging plate pivotally carried within said slot in said sleeve, one end of said second plate disengaged from said right-hand guided gear when pivoted to one extreme, and in engagement with said gear when pivoted to the opposite extreme;

a flat, resilient spring with the two longitudinal ends depending therefrom having one end contacting said first plate and the other end contacting said second plate;

said spring adapted to simultaneously pivot one plate to the engaged extreme and pivot the other plate to the disengaged extreme;

said locking means adapted to selectively engage one of said gears to lock it against rotation relative to said sleeve, and to simultaneously disengage the other of said gears to allow rotation thereof relative to said sleeve, whereby locking of one gear will cause the guide tooth thereof to slide within its associated groove upon longitudinal movement of said shank, causing said sleeve to rotate about said shank;

switch means carried within said longitudinally extending slot, connected to said gear engaging locking means, to switch engagement of one gear to the other;

a sleeve housing removably mounted about the enlarged portion of said sleeve and adapted to hold said gear-holding means in position in said sleeve, and to hold said gear engaging plates and said switch means in position within said slot;

said sleeve housing having means mounted thereon for releasably locking said plier arms in a closed position, said plier arm locking means adapted to automatically lock said plier arms when they are closed and adapted for manual two-handed release of said plier arms; and a removable knob attached to the end of said shank which projects from said sleeve.

2. The reversible safety wire pliers as set forth in claim 1, wherein said shank has an enlarged portion at one end slightly smaller than the interior diameter of said sleeve, and further comprising a compression spring surrounding said shank within said sleeve, biasing against the enlarged end of said shank at one end and against a portion of said gear holding means at the other end.

3. The reversible safety wire pliers as set forth in claim 2, wherein said plier arms releasable locking means includes:

a hook shaped latch mounted on the plier arm opposing said sleeve housing;

a generally U-shaped bracket affixed on said sleeve housing with its bottom portion spaced away therefrom to form a tubular portion, said tubular portion extending longitudinally therealong and having a longitudinally extending slot in the latch-adjacent side, said slot adapted to receive said latch when said plier arms are squeezed together;

an arm mounted for longitudinal slidable movement along said sleeve;

said arm having a rearward portion adapted to slide within the tubular portion of said U-bracket and of a length slightly longer than the tubular portion, whereby said rearward portion will project beyond the end of said tubular portion;

the rearward portion of said arm having a slot therein corresponding to the slot in said tubular portion;

said latch having a surface sloped towards the open portion of the hook; and means for biasing said arm away from the hook portion of said latch and parallel to said sleeve, whereby squeezing together of the plier arms will cause the sloped to surface of the latch to overcome the bias of said arm, sliding the arm until passing the hook of said latch, the biasing means then holding the arm against the hook such that the plier arms cannot be released without first overcoming the bias of said biasing means.

4. The reversible safety wire pliers as set forth in claim 3, wherein said means removably connected to said sleeve for holding said gears in their longitudinal position along said shank includes:

a snap ring removably inserted within an annular groove along the inside of said enlarged portion of said sleeve adjacent the end thereof, said locking ring adapted to bear against one end of said toothed gears when positioned within said annular groove;

a first removable stop key slidably inserted through a slot perpendicular to the longitudinal axis of said sleeve, the inner projecting edge of said stop key curved to conform to the outside diameter of said shaft and located to bear between said toothed gears, said first stop key having an outside edge curved to confrom to the outer diameter of said sleeve when inserted in its slot such that said sleeve housing will hold said stop in place within its slot in said sleeve; and a second removable stop key slidably inserted through a slot perpendicular to the longitudinal axis of said sleeve, the inner projecting edge of said stop key curved to conform to the outside diameter of said shaft and located between one end of one toothed gear and said spring means, said second stop key having an outside edge curved to conform to the outer diameter of said sleeve when inserted in its slot such that said sleeve housing will hold said stop in place within its slot in said sleeve.

* * * * *